United States Patent [19]

van der Lely

[11] 4,006,574

[45] Feb. 8, 1977

[54] METHOD OF FORMING A CONSTRUCTION OF BUILDING SUBSTRUCTURES

[76] Inventor: Cornelis van der Lely, 7, Bruschenrain, Zug, Switzerland

[22] Filed: June 30, 1975

[21] Appl. No.: 591,947

Related U.S. Application Data

[63] Continuation of Ser. No. 393,023, Aug. 30, 1973, abandoned.

[30] Foreign Application Priority Data

Sept. 1, 1972 Netherlands ..... 7211909

[52] U.S. Cl. ..... 52/742; 52/169.4; 52/236.5; 52/745

[51] Int. Cl.[2] ..... E04B 1/35; E04G 21/00

[58] Field of Search ..... 52/79, 236, 169, 741–745, 52/747, 742

[56] References Cited

UNITED STATES PATENTS

| | | | |
|---|---|---|---|
| 2,006,650 | 7/1935 | O'Reilly | 52/169 X |
| 2,899,771 | 8/1959 | Burris, Jr. | 52/169 |
| 3,289,382 | 12/1966 | van Der Lely | 52/79 X |
| 3,430,398 | 3/1969 | Green | 52/79 |
| 3,457,690 | 7/1969 | Clercq | 52/236 X |
| 3,510,997 | 5/1970 | Ratych | 52/79 |
| 3,555,763 | 1/1971 | Bloxom | 52/745 |
| 3,679,177 | 7/1972 | Scholz | 52/747 X |
| 3,688,457 | 9/1972 | Sherno | 52/169 |
| 3,720,034 | 3/1973 | Dawley | 52/742 |
| 3,722,168 | 3/1973 | Comm | 52/742 |
| 3,791,087 | 2/1974 | Sigal | 52/79 |

FOREIGN PATENTS OR APPLICATIONS

| | | | |
|---|---|---|---|
| 1,518,637 | 7/1966 | France | 52/79 |
| 269,923 | 6/1964 | Netherlands | 52/236 |
| 1,083,552 | 9/1967 | United Kingdom | 52/79 |

*Primary Examiner*—Price C. Faw, Jr.
*Assistant Examiner*—Leslie Braun
*Attorney, Agent, or Firm*—Mason, Mason & Albright

[57] ABSTRACT

A substructure and method of forming same for a building assembled from relatively large prefabricated box-shaped elements which are transported on highways to the building site. A concrete base slab is formed either by pouring or precast parts on an excavated building site. Large, heavy concrete substructure sections are transported by truck, tractor trailer or other transport to near the slab, but out of the excavation, where they are orientated with their longitudinal axes parallel to their desired position in the completed building. A plurality of truss-type beams are placed to form a bridge from the truck bed to the slab and pulleys are placed in anchors previously provided on the far end of the slab proximate its sides. Cables, connected on each side of the section remote from the slab, are led through the pulleys and back to a winch on the transport by means of which the section is caused to slide off the transport, across the bridge and the slab to the far end of the slab. This is repeated for successive substructure sections which are thus placed on the slab in an abutting relationship. The seams between them are filled and supporting columns are provided in two rows in the substructure so formed. Slideways are provided on top of the substructure across which building elements are passed and which provide a crawl space between the substructure and the overlying building structure for water, gas, plumbing and electrical lines.

23 Claims, 8 Drawing Figures

METHOD OF FORMING A CONSTRUCTION OF BUILDING SUBSTRUCTURES

SUMMARY OF THE INVENTION

This is a continuation of application Ser. No. 393,023 filed Aug. 30, 1973, now abandoned.

This invention relates to building substructures.

According to one aspect of the invention, there is provided a method of forming at least part of the substructure of a building, wherein the method includes the step of employing at least one prefabricated three-dimensional section or unit.

For a better understanding of the invention, and to show how the same may be carried into effect, reference will now be made, by way of example, to the accompanying drawings, in which:

DESCRIPTION OF THE PREFERRED EMBODIMENTS

Figure 1:
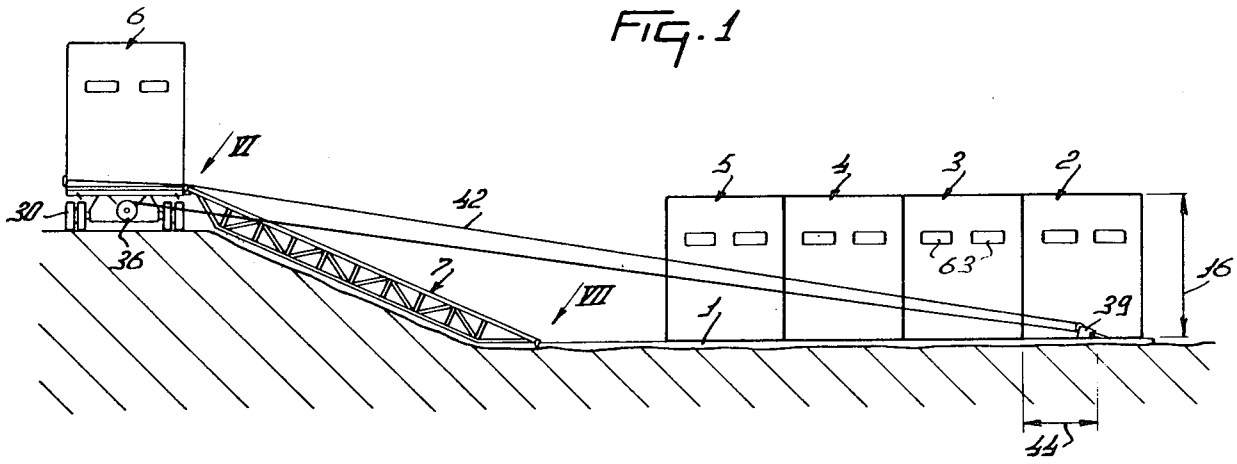
FIG. 1 is an elevation illustrating the installation of a building substructure by a method in accordance with one aspect of the invention.
Figure 3:
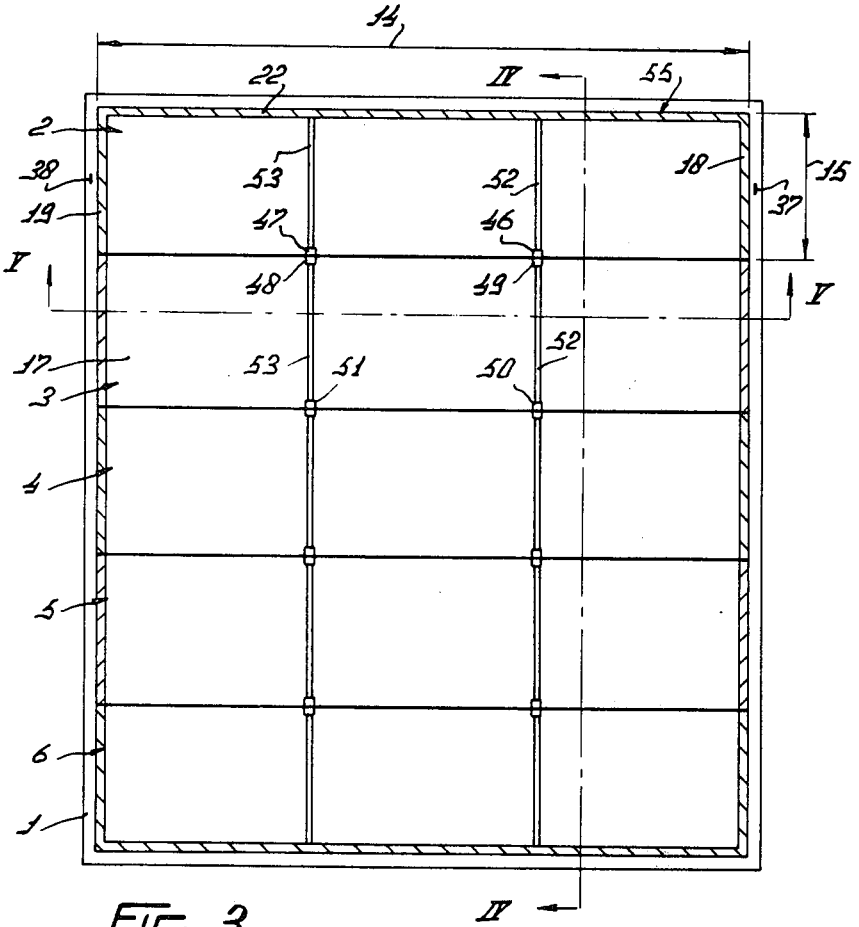
FIG. 3 is a plan view of the completed substructure of FIGS. 1 and 2.
Figure 4:
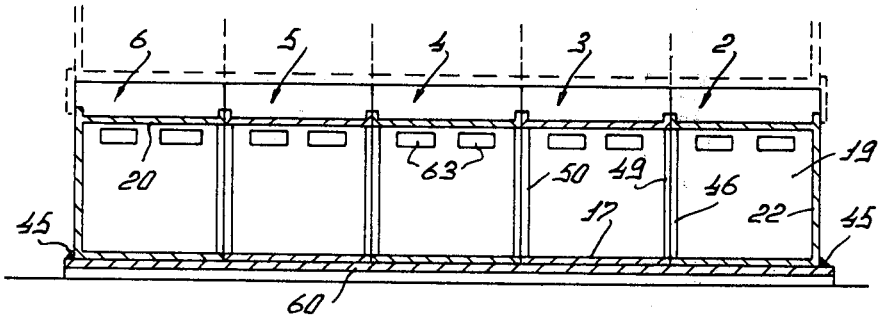
FIG. 4 is a section taken on the line IV—IV of FIG. 3.

Referring to the drawings, FIG. 1 thereof illustrates a foundation slab 1 upon which four prefabricated three-dimensional concrete sections or units 2, 3, 4 and 5 are arranged in juxtaposed neighboring relationship. A fifth section 6 is required to complete the substructure of the building that is to be erected and this section 6 is shown in FIG. 1 on a vehicular transporter 30 awaiting displacement to its appointed position alongside the section or unit 5. The complete assembled substructure comprising the five sections or units 2 to 6 inclusive and the underlying foundation slab 1 is shown in FIGS. 3 and 4 of the drawings.

Figure 2:
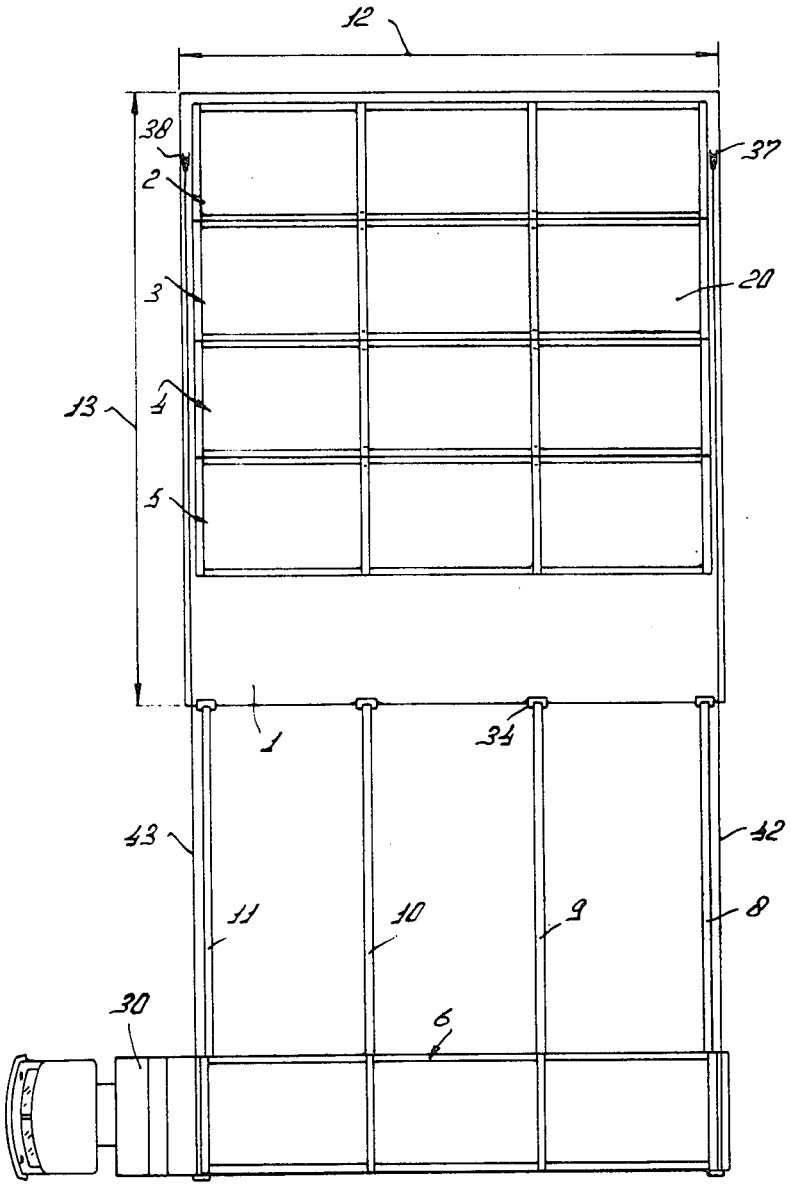
FIG. 2 is a plan view corresponding to FIG. 1.

The substructure is formed in the following manner. The foundation slab 1 is formed from concrete at a desired level below that of the surrounding terrain which desired level, in the illustrated embodiment, is substantially 2.5 meters beneath that of the surrounding terrain. The slab 1 is formed from concrete and has a flat horizontal upper surface with a shape and area which substantially corresponds to those of a lower region of the building that is to be erected. In the illustrated embodiment, the slab 1 has a width 12 of substantially 13 meters and a length 13 of substantially 14 meters. It is emphasized that, while the foundation slab 1 may alone constitute the foundation of the building that is to be erected, said slab 1 may actually be disposed on top of underlying elements such as piles, beams or the like. This will be decided in each particular case by the nature and location of the ground upon which the building is to be erected in accordance with established surveying and associated techniques. The height and consequential weight of the building that is to be erected must also be taken into consideration. Once the foundation slab 1 is complete, the prefabricated sections 2 to 6 inclusive are disposed thereon. These sections are supplied, ready made, to the building site from vehicular transporters such as the diagrammatically illustrated transporter 30 and it will be seen from FIGS. 1 and 2 of the drawings that each transporter 30 is stationed at the building site with its longitudinal axis substantially parallel to one side of the foundation slab 1. A bridge-like slideway 7 is arranged between the load-supporting surface of the transporter 30 and the nearest side or edge of the foundation slab 1, said slideway 7 consisting, in this embodiment, of 4 similar portions 8, 9, 10 and 11 that are arranged in parallel but regularly spaced apart relationship as can be seen in FIG. 2 of the drawings.

Figure 6:
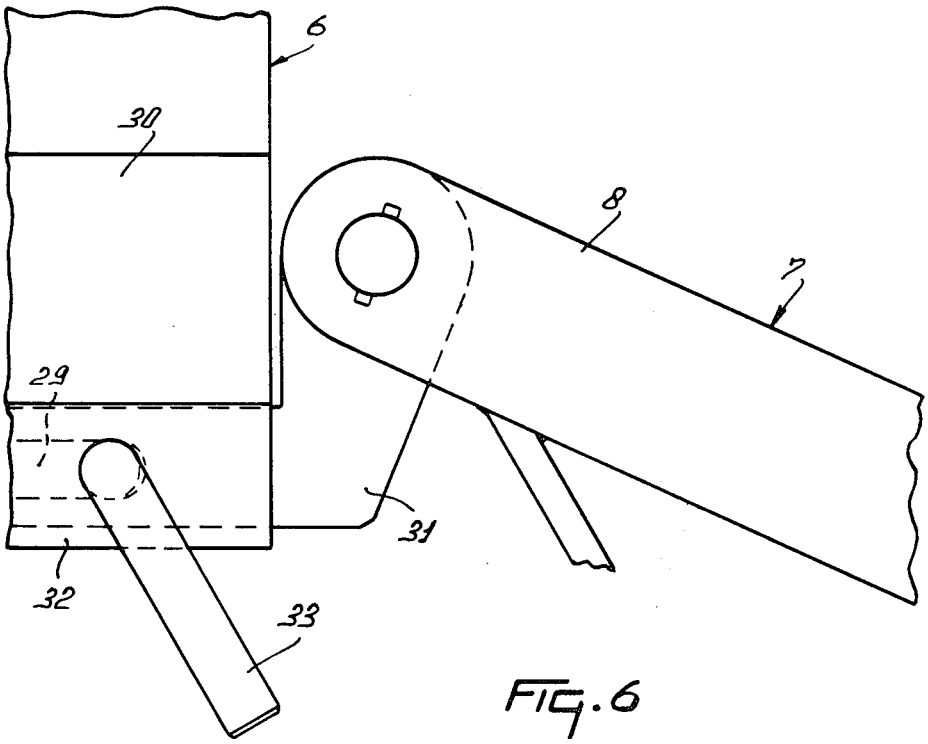
FIG. 6 is a fragmentary elevation, to an enlarged scale, showing details of the connection of a slideway to a transporter at the location indicated by an arrow VI in FIG. 1.

Each of the portions 8 to 11 of the slideway 7, as can be seen in respect of the portion 8 thereof in FIG. 1 of the drawings, consists of a girder framework at the top of which is disposed a slide beam. It is preferred that the slide beams of the outer portions 8 and 11 should be provided with upright guide rims so that the sections of the substructure can move downwardly along the slideway 7 with guidance against excessive lateral displacement by the rims that have just been mentioned. Each of the slideway portions 8 to 11 inclusive is provided at its upper end where it joins the transporter 30 with a corresponding coupling member 31 (FIG. 6). The coupling member 31 is in the form of a pin that is arranged to be received in a holder 32 of the transporter and to be retained in that holder by a transverse locking pin 33. The locking pin 33 is entered through a transverse slot 29 in the coupling member 31 so that some degree of movement of the member 31 relative to the holder 32 will be possible to facilitate easy connection of the slideway 7 to successive transporters at any particular building site.

Figure 8:
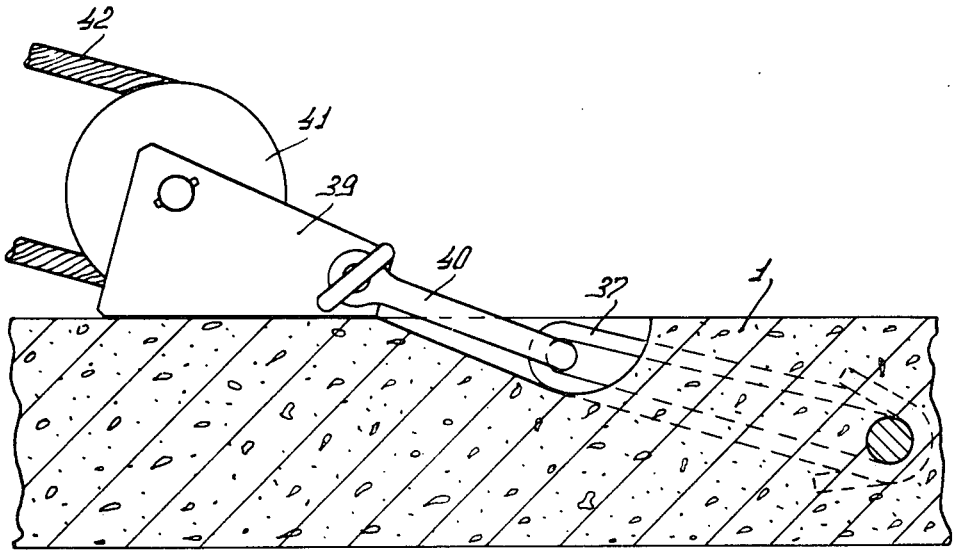
FIG. 8 is a fragmentary elevation, to an enlarged scale, illustrating details of an anchorage to the foundation.
Figure 7:
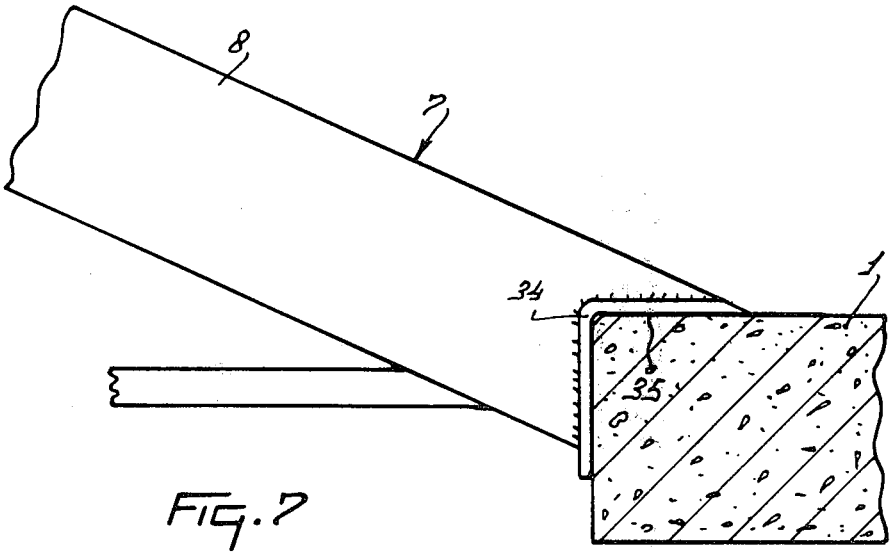
FIG. 7 is a fragmentary elevation, to an enlarged scale, showing the connection of the opposite end of the slideway to a foundation at the location indicated by an arrow VII in FIG. 1.

The lowermost end of each portion 8 to 11 inclusive of the slideway 7 is provided with a corresponding rightangled coupling plate 34 (FIG. 7) that embraces the adjacent edge or rim 35 of the foundation slab 1. The foundation slab 1 may, if considered necessary, be provided with means by which the coupling plate 34 or alternative coupling members can be positively connected to that slab. Winches 36 (FIG. 1) are provided beneath the loadsupporting surface of the transporter 30 adjacent both the front and the rear of that transporter. The foundation slab 1 is provided with co-operating anchorages 37 and 38 (FIGS. 3 and 2) and the details of the anchorage 37 are shown in FIG. 8 of the drawings. The anchorage or fastening means 37 comprises a strong metallic loop firmly embedded in the concrete of the slab 1 but with a portion thereof projecting upwardly into a downward recess in the upper surface of the concrete of the slab. A pulley block 39 is releasably and pivotally connected to the anchorage 37 by an eye member 40. The pulley block 39 carries a rotatable pulley 41 and a winch cable 42 is guided around that pulley. A similar winch cable 43 indirectly co-operates with the anchorage 38 and with the winch 36 (now visible) that is located near the front of the transporter 30. The free ends of the cables 42 and 43 are releasably connected to the sections, such as the section or unit 6 illustrated in FIG. 1, carried by the transporter 30 and it will be noted that the releasable connection is located at the side of that section 6 that is farthest from the already assembled sections 2 to 5 inclusive.

Upon winding in the cables 42 and 43 of the winches 36, the section 6 will be displaced to the right as seen in FIG. 1 of the drawings and will move off the load-supporting surface of the transporter 30 and onto the upper end of the slideway 7. As the cables 42 and 43 are farther wound in, the section 6 will progress down the portions 8, 9 and 10 and 11 of the slideway 7 until it eventually arrives on the upper surface of the foundation slab 1. The winches 36 continue to be driven until the section 6 has eventually reached its appointed position alongside the section 5. The sections may, if considered necessary, be provided at the bottoms thereof with slide bars, slide blocks or the like which are so arranged that the sections slide principally on those bars or blocks during their displacement to their appointed positions in the substructure. It is also possible to furnish the foundation slab 1 itself with slideway or slide blocks to assist in the ready displacement of the sections or units without damage. The various slide bars, slide blocks and slide-ways that have just been mentioned may all be left in the sections or units or in the foundation slab 1 when the sections or units 2 to 6 inclusive have reached their final appointed positions in the substructure. The foundations slab 1 may be provided with upright rims for co-operation with the sections 2 to 6 in such a way that said sections fit between the upright rims which thus constitute lateral guides.

The cables 42 and 43 push the sections 2 to 6 inclusive into successive abutting relationship with one another because, as noted above, the free ends of the cables 42 and 43 are releasably connected to the sides of the successive sections that are furthest remote from the anchorages 37 and 38. Those sides of the sections 2 to 6 inclusive may be provided with coupling means by which the cables 42 and 43 may be temporarily connected thereto or, alternatively, at least one clamp or the like may be provided for connecting the cables 42 and 43 temporarily to the successive sections. The cables 42 and 43 are disposed along the shortest sides or ends of the sections or units 2 to 6 during an operation such as that indicated in FIG. 1 of the drawings and the anchorages 37 and 38 are disposed in positions which are such that said anchorages will be close to the opposite shorter sides or end of the section 2 once that section has reached its appointed position. The anchorages 37 and 38 are thus disposed quite close to that side or edge of the foundation slab 1 that is farthest from the unloading position of each transporter 30 and in the region of which the first section 2 comes to rest in its final appointed position. The anchorages 37 and 38 are, of course, so disposed that the winch cables 42 and 43 can be employed to displace the section the foundation slab 1 for the full distance that is required to bring that section or unit to its appointed position. When the section 2 has reached its appointed position, the anchorages 37 and 38 are still perpendicularly spaced from a substantially vertical plane containing the side of the section 2 that is closest to the slideway 7 by a distance 44 that can be seen in FIG. 1 of the drawings. It will be realized that the vertical side of the section 2 that has just been mentioned is the side at which the temporary connections of the winch cables 42 and 43 to that section are made during the displacement thereof. The winches 36, their cables 42 and 43 and the anchorages 37 and 38 together afford displacing members by which, in this embodiment, the sections 2 to 6 inclusive are successively moved from the transporters 30 to their appointed positions on top of the foundation slab 1. Seams between the abutting sections 2 to 6 inclusive are closed when those sections are brought into substantial contact with one another or during subsequent operations or both. A seal 45 (FIG. 4) is provided around the foot of the sections 2 to 6 inclusive at the junction thereof with the upper surface of the foundation slab 1. Moisture is thus excluded from the floor 17 of the substructure which floor is afforded by the bottoms of the six sections 2 to 6 inclusive.

Each of the sections or units 2 or 6 inclusive is of elongated configuration and has a length 14 which may be substantially 12 meters, a width 15 which may be substantially 2.5 meters and a height 16 that may be substantially 3 meters. These dimensions are, of course, given purely by way of example and other dimensions may be chosen when required. Each of the sections 2 to 6 inclusive substantially encloses a space and said sections may thus be considered as being prefabricated building sections or room units. The enclosed spaces are all part of the interior of the substructure. It can be seen from FIGS. 3 and 4 of the drawings (in relation to the section 2) that each section or unit comprises, in addition to its floor 17, two substantially vertical walls 18 and 19 that define the opposite shorter sides or ends of the section concerned.

Figure 5:
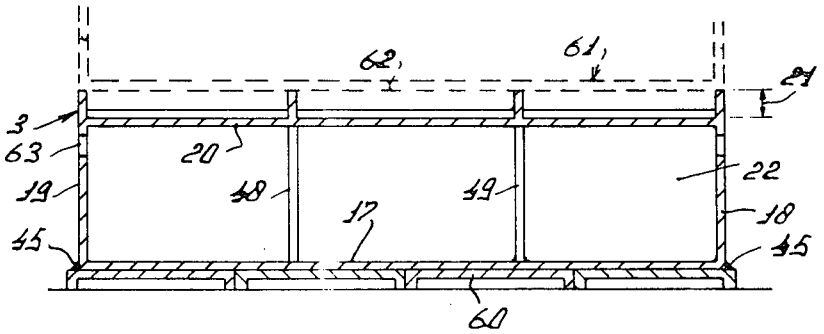
FIG. 5 is a section taken on the line V—V of FIG. 3.

The top of each section is completely closed by a corresponding roof ceiling 20 that is, in fact, located at a vertical distance 21 (FIG. 5) of substantially 60 centimeters beneath a horizontal plane containing the uppermost edges of the walls 18 and 19. The section 2 is an end section or unit of the substructure and is therefore provided at its outermost long side with a vertical wall 22 the height of which is the same as that of the walls 18 and 19. The opposite longer side of the section or unit 2 that adjoins the section 3 is, however, completely open and it will be seen from the drawings that the interior three sections 3, 4 and 5 each have only their floors 17, their upright walls 18 and 19 and their roofs or ceilings 20. The section 6 at the opposite end of the substructure from the section 2 is substantially symmetrically identical to the section 2. There are thus no walls that are parallel to the walls 22 between the outer longer sides of the farthest remote sections 2 and 6.

The sections 2 to 6 are prefabricated principally from concrete which may, however, include mesh, rods or other reinforcements. The concrete may, if desired, be pre-stressed. Although it is preferred to make the sections wholly or principally from concrete, the sections may, if desired, include metal beams or other elements. Such beams can be arranged so that they will not have surfaces that are exposed at the exterior of the assembled substructure. It is not essential that the sections should be completely closed at the top by the roofs ceilings 20. They may, as an alternative, be wholly or partly open at the top. Moreover, the internal spaces that are enclosed by the sections may be sub-divided into two or more smaller spaces by at least one internal wall or partition that is preferrably arranged in the section concerned during the prefabrication thereof. The superstructure 61 of a building that is to be erected is assembled on top of the substructure afforded by the sections 2 to 6, the tops of those sections or units being constructed to carry the required superstructure.

The substructure that has been described is particularly suitable for carrying a superstructure 61 of prefabricated three-dimensional building sections. The building sections or room units of the superstructure may be slidably displaced into their appointed positions on top of the substructure and the upper edges of the walls 18 and 19 of the sections 2 to 6 inclusive can, for this purpose, be constructed to afford guiding slideways. In order to furnish additional support for the overlying superstructure 61 between the walls 18 and 19, the sections 2 to 6 inclusive are provided with supporting columns 46 and 47 such as those illustrated at the side of the section 2 remote from its wall 22. In this embodiment, the columns 46 and 47 divide the length 14 of each section into three substantially equal parts by this is not, of course, essential and alternative positionings of the columns 46 and 47 are possible. The sections 3, 4 and 5 that are all sandwiched between further sections and which accordingly have completely open longer sides, have supporting columns 48 and 49 at one of those longer sides and further supporting columns 50 and 51 at the opposite longer side. The supporting columns 48 to 51 inclusive register with the columns 46 and 47 in horizontal directions that are parallel to the planes of the walls 18 and 19 and it will be evident that the supporting columns considerably increase the rigidity of the sections and assist in sustaining the roofs or ceilings 20. Connections 52 and 53 (FIG. 3) extend parallel to the walls 18 and 19 between the tops of pairs of columns such as the pairs 48 and 51 on one hand and 49 and 50 on the other. The connections 52 and 53 are preferably located in such positions that their tops are substantially level with the tops of the walls 18 and 19. The connections 52 and 53 constitute substantially horizontally aligned supporting beams that extend throughout substantially the whole of the length 13 of the substructure. As previously mentioned, the upper edges of the walls 18 and 19 may be formed as guiding slideways by the use of upright rims or the like so that the building sections of the overlying superstructure can be displaced slideably therealong to their appointed positions.

When the sections 2 to 6 inclusive are intended for use in a substructure on which a superstructure is to be built from a plurality of prefabricated building sections, it is advantageous to construct the slideway portions 8, 9, 10 and 11 with coupling plates 34 or other coupling means that can be releasably connected to the upper edge of the outer long wall 22 of the section 6. Suitably co-operating coupling members may be provided for this purpose at or near the upper edge of the wall 22 concerned. With such a construction, it is possible to use the bridge-like slideway 7 to move building sections of the superstructure from successive transporters 30 into their appointed positions on top of the sections 2 to 6 inclusive of the substructure. The slideway portions 9 and 10 will be connected to the top of the wall 22 of the section 6 in positions that they are in line with the previously described connections 52 and 53 whereas the portions 8 and 11 of the slideway 7 will be disposed so as to be substantially in line with the walls 18 and 19. The winch cables 42 and 43 can again be employed in substantially the same manner as has already been described but, in the case of the superstructure, the pulley blocks 39 will co-operate with alternative anchorages disposed on the top 55 (FIG. 3) of the section 2.

The foundation slab 1 is shown in FIGS. 1 to 3 of the drawings as being a concrete slab that is cast in situ. However, as an alternative, the foundation may be formed by assembling a plurality of prefabricated concrete plates 60 (FIGS. 4 and 5 of the drawings) in juxtaposed relationship. Such plates 60 are preferably of oblong configuration and are arranged with their maximum lengths perpendicular to the lengths 14 of the sections 2 to 6 inclusive. This is not, however, essential and they may be square as seen in plan. In either case, they preferably have the inverted shallow channel-shaped cross-sectional configuration that can be seen in FIG. 5 of the drawings. Although it is preferred to displace the sections 2 to 6 to their appointed positions in the substructure in directions that are substantially parallel to their widths 15, this is not essential and it is equally possible to displace them in directions that are substantially parallel to their lengths 14. Under such circumstances, the successive transporters 30 will be located with their longitudinal axes substantially parallel to the length 13 of the foundation slab 1 and a suitably dimensioned slideway will be arranged to extend between the rear end of each transporter 30 and an appropriate location at an edge of the foundation 1. It is noted that the space above each roof ceiling 20 and below the floor 62 of the superstructure 61, which space has the height 21 shown in FIG. 5 of the drawings, can be employed for the reception of pipes and conduits for water, gas, electricity and so on and for waste discharge pipes and the like. The space in question may have sufficient dimensions to enable operatives to crawl therethrough.

The method of making a substructure that has been described is particularly convenient in use when that substructure is to be disposed in an excavation so that at least the foundation thereof will be located beneath the general level of the surrounding terrain. The sections of the substructure can be simply and easily moved by the cables 42 and 43 of the winches 36 along the slideway 7 and into their appointed positions in the substructure. The slideway 7 and its associated parts are required only temporarily during the erection of a building and they can readily be placed in position before the major building operation commences. Similarly, they can quickly and easily be removed once the building is complete. It will be noted particularly that no cranes are employed since, when at least the foundation of a building that is to be erected is located in a pit or other excavation, great care must be exercised in the use of cranes inasmuch as they cannot be arranged too close to the edge of that pit or other excavation and because the heavy weight of prefabricated concrete sections prevents the use of most cranes that might possibly otherwise be employed to lift the sections from transporters and swing them to location substantially vertically above their appointed positions. By excluding cranes from the method that has been described, the weights of the various sections or units are rendered much less important and heavy concrete sections be brought to their appointed positions on foundations without difficulty. For example, sections or units having individual weight of as much as 30 tons can be handled readily by a method in accordance with the invention and can be brought to their appointed positions on the foundation slab 1 without difficulty. A substructure of sections that has been formed substantially wholly from concrete is particularly desirable when that substructure is to be located wholly or principally, as in the embodiment which has been described by way of example, beneath the general level of the surrounding terrain. Such a substructure will generally be substantially completely surrounded by soil when the building is finished and it will be evident that it is particularly suitable for use as the cellar of a building.

In the embodiment which has been described by way of example, the sections 2 to 6 inclusive are formed with small windows 63 which are so positioned that they will eventually be located just above ground level. At least one cellar door and or other openings may, if required, be provided in appropriate sections. Even if the substructure of a building that is to be erected is to be located wholly or principally above the general level of the surrounding terrain, it is still advantageous to form that substructure from sections or units that are wholly or principally of a concrete construction. The co-operation of the bottoms of the sections directly with an underlying supporting foundation ensures a firm and satisfactory support of the substructure.

Although various features of the method of assembly of a substructure that has been described and or illustrated in the accompanying drawings and various features of the apparatus used in that method will be set forth in the following claims as inventive features, it is emphasized that the invention is not necessarily limited to those features and that it includes within its scope all of the steps in the method that has been described or illustrated or both in the accompanying drawings and each part of the apparatus that has been described and illustrated in the accompanying drawings both individually and in various combinations.

What we claim is:

1. A method of forming the substructure of a building constructed by being assembled from prefabricated box-shaped elements each having dimensions compatible with being transported on highways by transport vehicles, the method comprising the steps of:

excavating a building site at a desired level below that of the surrounding terrain;

forming a concrete slab in said excavation which has a flat horizontal upper surface and a shape and area which substantially corresponds to the lower portion of the building to be erected;

transporting on a transport vehicle which is provided with winch means, at least one elongated three-dimensional concrete substructure section intended for the substructure of the building to adjacent said excavation whereby the longitudinal axis of said substructure section is substantially parallel to the place it will occupy in the completed building and its shorter ends are substantially in the same plane as they will occupy in the completed building;

providing at least two parallel bridge members directly between and connected to the portion of said transport vehicle carrying said substructure section and said concrete slab;

connecting pulley means adjacent the remote end of said slab on either side of the place said substructure section will occupy in the finished building and providing a pair of flexible members each engaging a separate said pulley with one end of each said flexible member connected to the longer side of said substructure section which is most remote from said concrete slab, the other end of each said flexible member being connected to said winch means;

displacing said substructure section across said bridge members and said concrete slab to its desired place in the building by winding each said flexible member by said winch means;

disengaging said bridge members from said transport vehicle and transporting further concrete substructure sections to substantially the same position described for said first mentioned substructure section and by the same steps heretofore described for displacing said first mentioned substructure, displacing each said further substructure section to its desired position on said slab in the completed building whereby said substructure sections are in an abutting relationship with one another and the substructure of the building is substantially completed.

2. A method as claimed in claim 1 comprising the further step of closing the seams between said abutting substructure sections.

3. A method as claimed in claim 1, wherein metal beams are provided in said substructure sections so that the surfaces thereof are not exposed to the exterior of the assembled substructure.

4. A method as claimed in claim 1, wherein guiding slideways are provided on the tops of said substructure sections whereby building elements for the overlying portion of the building can be slidably displaced to their desired positions in the completed building over said assembled substructure.

5. A method as claimed in claim 1 wherein supporting columns are placed in said substructure sections for increasing the rigidity of said sections and contributing to the support of the overlying portion of the building.

6. A method as claimed in claim 1 wherein said concrete slab is precast in parts and said slab parts are moved to said excavation and laid therein with their flat horizontal surfaces in the same plane.

7. In a method of forming the substructure of a building, the use of at least one prefabricated three-dimensional substructure section, said method including excavating the ground at the building site, forming a foundation slab of concrete in the excavation which has a width greater than the length of said prefabricated section and a length greater than said width, anchoring a pulley in said slab at each of the longer edges thereof and nearer to a shorter edge of said slab than a distance equal to the width of said section, transferring said section into the excavation by transporting it on a truck bed to adjacent said excavation, placing a slideway so that it is connected to a longer side of said truck bed and an edge of said slab opposite the shorter edge near to which said pulleys are anchored, placing a cable on said section on said truck bed whereby said cable connects a side of said section opposite said slideway on one end and extends to a said pulley around which it is received and from whence it extends back to a winch on said truck and then by said winch drawing said section across said slideway and slab to its predetermined place on the latter, and subsequently transferring a further prefabricated three-dimensional section on top of said first mentioned section.

8. A method as claimed in claim 7, wherein said foundation slab is formed by arranging a plurality of prefabricated concrete plates in juxtaposed side-by-side relationship in said excavation.

9. A method as claimed in claim 7, wherein said slideway is arranged in an inclined position with its higher one end connected to said transporter and the opposite end bearing directly on said foundation.

10. A method as claimed in claim 7, wherein said first mentioned section is of oblong configuration, and wherein said first mentioned section is displaced onto and over said foundation in a direction substantially parallel to said first mentioned section's shorter sides.

11. A method as claimed in claim 10, wherein said cable is coupled to the rear of said first mentioned section with respect to the direction in which that section is to be displaced, said cable extending alongside a shorter side of said section.

12. A method as claimed in claim 7, wherein a plurality of prefabricated three-dimensional substructure sections are placed beside said first mentioned section and a plurality of prefabricated building sections intended to form part of a superstructure of a building that is to be erected are disposed on top of said sections of the substructure during further steps in the erection of the building.

13. A method of forming the substructure of a building constructed by being assembled from prefabricated box-shaped elements each of which has dimensions capatible with being transported on highways by transport vehicles, the method comprising, the steps of:

providing a level building site;

forming a concrete slab on said building site which has a flat horizontal upper surface and a shape and area which substantially corresponds to the lower portion of the building to be erected;

transporting on a transport vehicle which is provided with winch means at least one elongated three-dimensional concrete substructure section intended for the substructure of the building adjacent said concrete slab whereby the longitudinal axis of said substructure section is substantially parallel to the place it will occupy in the completed building and its shorter ends are substantially in the same plane that they will occupy in the completed building;

providing at least two parallel bridge members directly between and on one end connected to the portion of said transport vehicle carrying said substructure section and said concrete slab whereby it abuts against an edge of said concrete slab;

connecting pulley means adjacent the remote end of said slab on both sides of the location said substructure section will occupy in the completed building and providing a pair of flexible members each engaging separate said pulley with one end of each said flexible member connected to the longer side of said substructure section which is most remote from said concrete slab, the other end of each said flexible member being connected to said winch means on said transport vehicle;

displacing said substructure section across said bridge members and said concrete slab to its said location in the completed building by winding each said flexible member by said winch means;

disengaging said bridge members from said transport vehicle; and transporting further concrete substructure sections by a transport vehicle to substantially the same position described for said first mentioned substructure section and by the same steps set forth above for displacing said first mentioned substructure, displacing each said further substructure section to its predetermined location on said slab in the completed building whereby said substructure sections are in an abutting relationship with one another and the substructure of the building is substantially completed.

14. A method in accordance with claim 13, wherein performing the step of forming said concrete slab, anchor means for each said pulley are provided on said slab remote from the edge said parallel bridge members will abut and on both sides of the location said substructure will occupy in the completed building.

15. A method in accordance with claim 13, wherein said building site is provided at a lower level than the bed of said transport vehicle when it is in place for receiving said bridge members.

16. A method in accordance with claim 13, wherein said concrete slab comprises a plurality of prefabricated concrete plates which are placed in a juxtaposed side-by-side relationship at said building site whereby their length is substantially perpendicular to said longitudinal axis of said substructure section.

17. In a method of forming the substructure of a building, the use of a plurality of prefabricated three-dimensional elongated substructure sections, each of which includes a continuous floor, a ceiling and supporting walls, and a further plurality of elongated rectangular concrete foundation slabs, said method including the preparation of the ground at the building site for receiving said slabs, the placing of said slabs on said building site in a coplanar side-by-side adjoining relationship whereby they form and completely cover on the prepared building site a rectangle of the approximate area in plan of the completed building, and have their longitudinal axes perpendicular to the longitudinal axes of the section to be received thereon, the transferring of said sections onto said slabs by bringing them one by one to the building site by transport vehicles and connecting a slideway with one end directly mounted on said transport vehicle where it carries said section and the other end received by said slabs, sliding said sections across said slideway and across said slabs individually to their location in the completed building, and providing a seal around the foot of said sections at their juncture thereof with the upper surface of said slabs whereby moisture is excluded from entering between the floor of the substructure formed by said floors of said sections and the underlying slabs.

18. A method in accordance with claim 17, wherein said building site is prepared by excavating the ground and providing a level place in said excavated area for receiving said slabs.

19. A method in accordance with claim 18, comprising the further step of closing seams between said abutting substructure sections.

20. A method in accordance with claim 18, wherein supporting columns are initially located in each substructure section for increasing the rigidity of said sections and contributing to the support of the overlying portion of the building, said supporting columns in each said substructure section abutting a supporting column in an adjacent substructure section when said substructure sections have been displaced to their predetermined position in the completed building.

21. A method of forming the substructure of a building constructed by being assembled from prefabricated box-shaped elements each of which has dimensions compatible with being transported on highways by transport vehicles, the method comprising the steps of:

forming a concrete slab on said building site which has a flat horizontal upper surface and a shape and area which substantially corresponds to the lower portion of the building to be erected;

transporting on a transport vehicle to adjacent said concrete slab at least one elongated three-dimensional substructure section in which supporting columns are initially located for increasing the rigidity of the section and contributing to the support of an overlying portion of the building whereby said section is intended for the substructure of the building, said section being transported to along side of said concrete slab with its longitudinal axis substantially parallel to the place it will occupy in the completed building and with its shorter ends substantially in the same plane that they will occupy in the completed building;

providing at least two parallel bridge members between said transport vehicle carrying said substructure section and said concrete slab;

connecting pulley means adjacent that end of the slab remote from where the transport vehicle is situated and on both sides of the location said substructure section will occupy in the completed building, said pulley means being situated nearer to that end of said slab than a distance equal to the width of said section, providing a pair of flexible members each engaging a separate said pulley means with one end of each said flexible member connected to the longer side of said substructure section which is remote from both said pulley means, said flexible means extending from said section along its shorter sides to and around said pulley means and being connected to winch means;

displacing said substructure section across said bridge members and said concrete slab to its said location in the completed building by winding each said flexible member by said winch means;

transporting further concrete substructure sections by a transport vehicle to substantially the same position described for said first mentioned substructure section and by the same steps set forth above for displacing said first mentioned substructure, displacing each said further substructure section to its predetermined location on said slab in the completed building whereby said substructure sections are in an abutting relationship with one another and the substructure of the building is substantially completed.

22. A method in accordance with claim 21, wherein said winch means is located spaced from the end of said slab opposite said pulley means.

23. A method in accordance with claim 22, wherein each said flexible member is turned around said pulley means substantially 180°.

* * * * *